US005356269A

United States Patent [19]

Stangroom

[11] Patent Number: 5,356,269

[45] Date of Patent: Oct. 18, 1994

[54] VARIABLE DISPLACEMENT PUMP

[75] Inventor: James E. Stangroom, Sheffield, England

[73] Assignee: ER Fluid Developments Limited, Sheffield, England

[21] Appl. No.: 108,182

[22] Filed: Aug. 17, 1993

Related U.S. Application Data

[63] Continuation of Ser. No. 807,841, Feb. 5, 1992, abandoned.

[30] Foreign Application Priority Data

Jun. 9, 1989 [GB] United Kingdom ..... 8913343.3

[51] Int. Cl.[5] ..... F04B 39/08

[52] U.S. Cl. ..... 417/297; 417/505; 137/909; 137/514

[58] Field of Search ..... 417/297, 505; 137/514, 137/517.7, 909; 251/54

[56] References Cited

U.S. PATENT DOCUMENTS

| | | | |
|---|---|---|---|
| 2,667,237 | 1/1954 | Rabinow | 137/909 |
| 3,098,502 | 7/1963 | Deve | 251/54 |
| 3,459,363 | 8/1969 | Miller | 417/446 |
| 4,114,125 | 9/1978 | Komatsu | 251/54 |
| 4,493,615 | 1/1985 | Stangroom | 417/48 |
| 4,742,998 | 5/1988 | Schubert | 137/807 |
| 4,749,004 | 6/1988 | Peash | 251/129.13 |
| 4,840,112 | 6/1989 | Bhadra et al. | 91/459 |

FOREIGN PATENT DOCUMENTS 1565878 4/1980 United Kingdom .

OTHER PUBLICATIONS

Fluid Power International No. 30, Dec. 1965, London GB p. 414 "A pump with valve lifters to control delivery".

Business Week Dec. 18, 1948 Magnetized Iron-Oil Mines in New Jobs pp. 48-50.

Journal of Applied Physics Dec. 1949 Induced Fibration of Suspensions pp. 1137-1140.

*Primary Examiner*—Richard A. Bertsch

*Assistant Examiner*—Peter Korytnyk

*Attorney, Agent, or Firm*—Trexler, Bushnell, Giangiorgi & Blackstone, Ltd.

[57] ABSTRACT

A variable displacement pump (3) comprises a piston (4) reciprocable within a cylinder (2), a displaceable inlet valve (5) adapted to control admission of lower pressure hydraulic fluid (9) to the swept volume area (10) of the piston (4) and cylinder (2), a displaceable outlet valve (7) adapted to control delivery of higher pressure fluid (9) from the swept volume area (10), and means (13, 13A, 26-28, 29-44) to control the position of the inlet valve (5) so as to control the volume of fluid (9) delivered by the pump (3) in accordance with demand.

4 Claims, 6 Drawing Sheets

VARIABLE DISPLACEMENT PUMP

This application is a continuation of application Ser. No. 07/807,841, filed Feb. 5, 1992, now abandoned.

BACKGROUND OF THE INVENTION

This invention is concerned with variable displacement pumps, which are used to power and control hydraulic systems.

In a simple hydraulic system a pump draws oil from a low-pressure reservoir and supplies it at high pressure to a consumer unit(s) such as a ram. The only losses in this system are due to leakage etc., in the pump and ram, and viscous loss in the pipes, but the ram speed is directly related to the pump speed.

As the fluid volumes demanded by the consumer unit(s) will usually be variable a common way of controlling such a system is to use a controllable bypass, which returns a proportion of the pump output to the reservoir without going through the ram. The speed of the latter can clearly be varied from zero, with the bypass fully open, to the maximum speed, with the bypass completely closed. However, this is very wasteful of energy. In a second form of control, a series valve is located in the high pressure supply, but this is just as inefficient. The valve raises pump pressure above that actually required, thereby wasting energy. At higher pressures, leakages within the pump become more significant, so they act as a bypass, to control the speed.

SUMMARY OF THE INVENTION

Whilst the speed of the simple system could be controlled by varying the speed of the pump drive, this is usually impractical, since the drive is either a constant speed electric motor or an engine with a limited speed range. Even if the speed could be varied, the control available could be very slow.

Conventionally, this problem is solved by the different forms of variable displacement pumps. Usually, these are piston pumps, in which the piston stroke is selectively variable by a swash-plate or eccentric, so that the amount of oil delivered per stroke is varied. The pump output can therefore vary independent of the speed of the prime mover. Unlike the systems previously referred to there are no losses caused by bypass or throttle valves.

Conventional variable displacement pumps are reliable and efficient. However, all of them need very high forces to move the swash plate or the eccentric, and an auxiliary power system, usually hydraulic, must be provided for this purpose. This increases the complexity and cost of the pump. Furthermore, because it is obviously undesirable to use a great deal of power to control the pump itself, the response is usually relatively slow. Control by electrical signals requires a further stage, such as electro-magnetic valves. These shortcomings have severely restricted the range of use of variable displacement pumps.

According to the present invention, there is provided a variable displacement pump comprising a piston reciprocable within a cylinder, a displaceable inlet valve adapted to control admission of lower pressure hydraulic fluid to the swept volume area of the piston and cylinder, a displaceable outlet valve adapted to control delivery of higher pressure fluid from the swept volume area, characterised in that an ER fluid device controls the position of the inlet valve so as to control the volume of fluid delivered by the pump in accordance with demand, the ER fluid device being used either in a passive mode as a brake, to restrain movement of the inlet valve, which movement results from forces generated by the normal working of the pump, or being used in an active mode, as a powered displacement device, to control the movement of the inlet valve directly.

Thus by maintaining the inlet valve open during the whole of the output or delivery stroke of the piston, the delivery is zero; conversely by maintaining the inlet valve closed during the whole of the output or delivery stroke of the piston, the delivery is maximum; while maintaining the inlet valve open during a portion only of the delivery stroke, delivery of only a portion of the swept volume occurs.

Preferably, the pump has a plurality of cylinders e.g., five, each with an inlet and an outlet valve. All the latter are preferably of the poppet type, spring loaded into closed positions, and displaceable by a decrease/increase in pressure to an open position.

BRIEF DESCRIPTION OF THE DRAWING

The invention will now be further described, and will be better understood, by reference to the accompanying drawings, in which.

DESCRIPTION OF THE PREFERRED EMBODIMENTS

Figure 1:
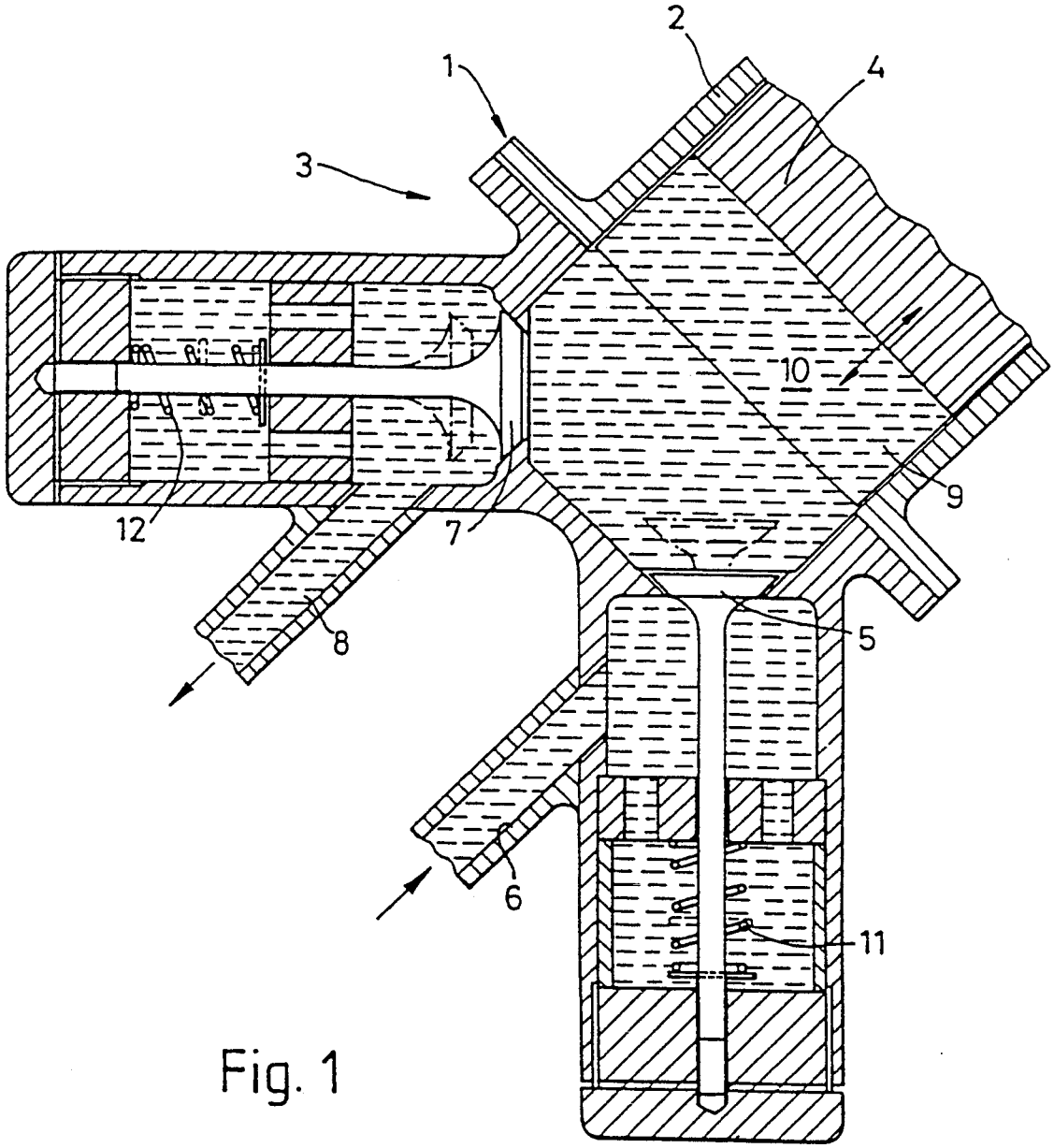
FIG. 1 shows the cylinder head of a conventional, fixed displacement piston pump.

In FIG. 1 is illustrated a cylinder head 1 of one cylinder 2 of a multi-cylinder pump 3, within which a cylinder 2 is a reciprocable piston 4, an inlet valve 5 with a fluid inlet port 6 and an outlet valve 7 with a fluid outlet port 8.

Figure 2A:
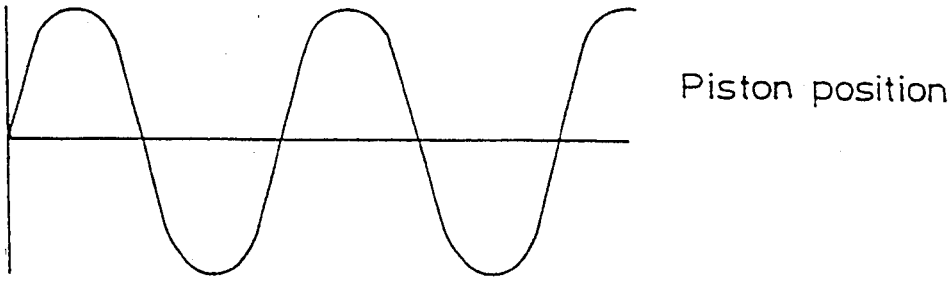
FIG. 2A shows the piston position.
Figure 2B:
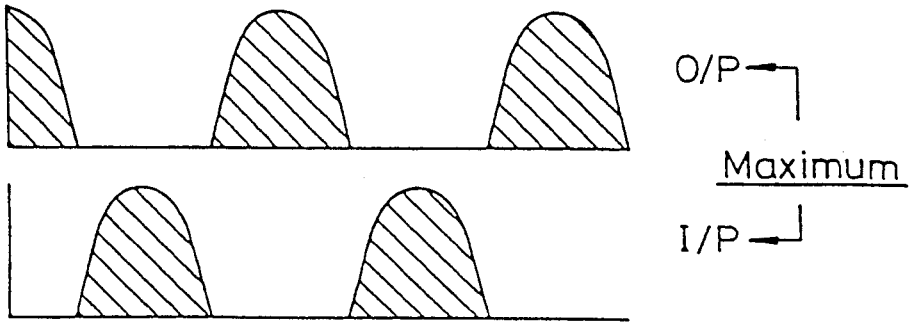
FIGS. 2B, 2C and 2D show respectively, hydraulic fluid pressures at the inlet and outlet ports for the piston position of FIG. 2A.

As the piston 4 is withdrawn, pressure of fluid 9 in swept volume chamber 10 falls, and the inlet valve 5 opens, being displaced, against the action of its coil spring 11, to the position shown in chain-dotted line. When the piston 4 starts to return, the inlet valve 5 closes, and the hydraulic fluid in the chamber 10 is compressed. When its pressure exceeds that in the outlet port 8, the outlet valve 7 is forced open against the action of its coil spring 12, and hydraulic fluid is expelled from the chamber 10 into, and beyond, the outlet port 8. As the piston 4 approaches the limit of its travel, the outlet valve 7 closes again under the influence of its spring 12, and the cycle is repeated. As the piston 4 moves to and fro, hydraulic fluid flows alternately through the inlet and the outlet ports 6, 8. This is shown in FIG. 2B. The output flow is then the maximum possible for a particular pump and speed.

In accordance with the invention however, the position of the inlet valve 5 is positively controlled, rather than being, conventionally either open or closed in accordance with fluid pressure(s) acting on the inlet valve 5 and/or its coil spring 11. Various means of achieving positional control of the inlet valve 5 are described later with reference to FIGS. 3–6, but in principle, if zero delivery is required (to match zero demand) the inlet valve 5 is held open all the time, the reciprocation of the piston 4 merely generating a tidal flow of hydraulic fluid in the lower pressure, inlet port 6. Apart from the return spring 11, the force tending to close the inlet valve 5 would be small, since the pressure drop across it would be small. The only energy losses would be due to viscosity. The fluid pressure within the chamber 10 would remain low, insufficient to open the outlet valve 7, so the output flow into, and beyond, the outlet port 8 would be zero.

Figure 2C:
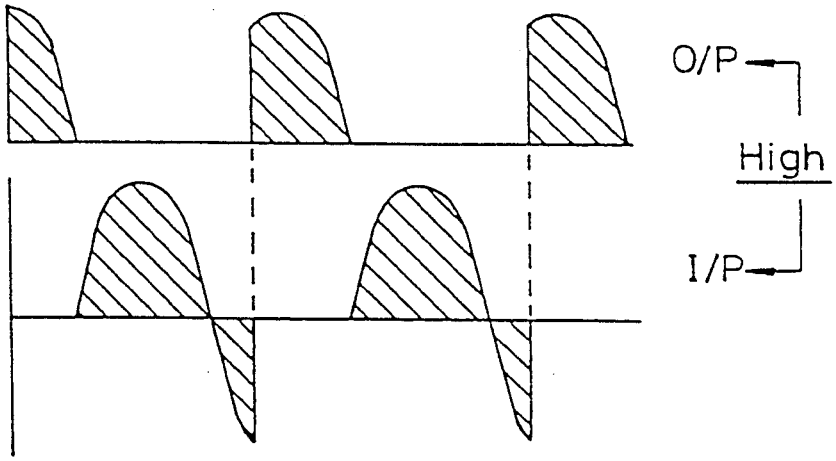
Figure 2D:
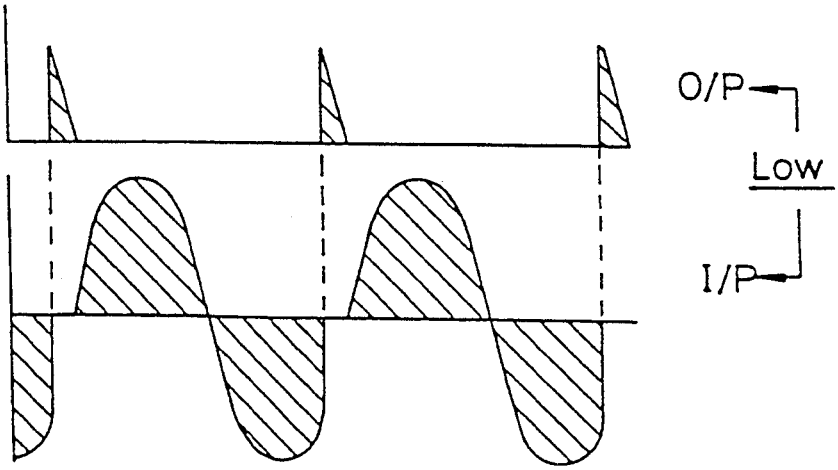

If part of the maximum delivery were then required, the inlet valve 5 would be held open during a selected initial part of the output stroke of the piston 4, the valve closing when released. Part of the hydraulic fluid initially contained in the chamber 10 would be expelled through the inlet port 6 as discussed above, but once the inlet valve 5 had closed, however, the remainder of the hydraulic fluid within the chamber 10 would be driven through the output port 8, as normal. The net output flow would therefore be intermediate between the maximum and zero, the exact amount depending upon the proportion of the output stroke remaining when the inlet valve 5 was released. FIGS. 2C and 2D show the flows observed at the inlet port 6 (I/P) and outlet port 8 (O/P) for 'High' and 'Low' output flows respectively. It must be stressed that since the 'excess' output is rejected into the low pressure port 6 etc., the energy losses will be low.

Thus by applying relatively small forces to the inlet valve 5 and thus controlling its position in accordance with the invention, and varying the phase relationship between these forces and the positon of the piston, the output of the pump can be varied from zero to the maximum swept volume.

The inlet valve 5 is controlled by the use of Electro-Rheological (ER) fluids. In essence, ER ..... fluids are concentrated suspensions of suitable solids, finely divided, in an oily base liquid. Normally these behave similarly to ordinary oils, but when they are exposed to an electric field, their flow behaviour changes to that of a Bingham plastic: the yield stress is dependent on the electric field strength. When the field is removed, the ER fluid reverts to its original liquid state. ER fluids are particularly suitable for this application because:

(a) ER devices are simple and require virtually no precision machining so they can be cheap to make.

(b) Although high voltages are required, current densities are modest, so the control signals can be provided directly by solid-state electronics.

(c) The response of ER fluids is very fast indeed.

Figure 3:
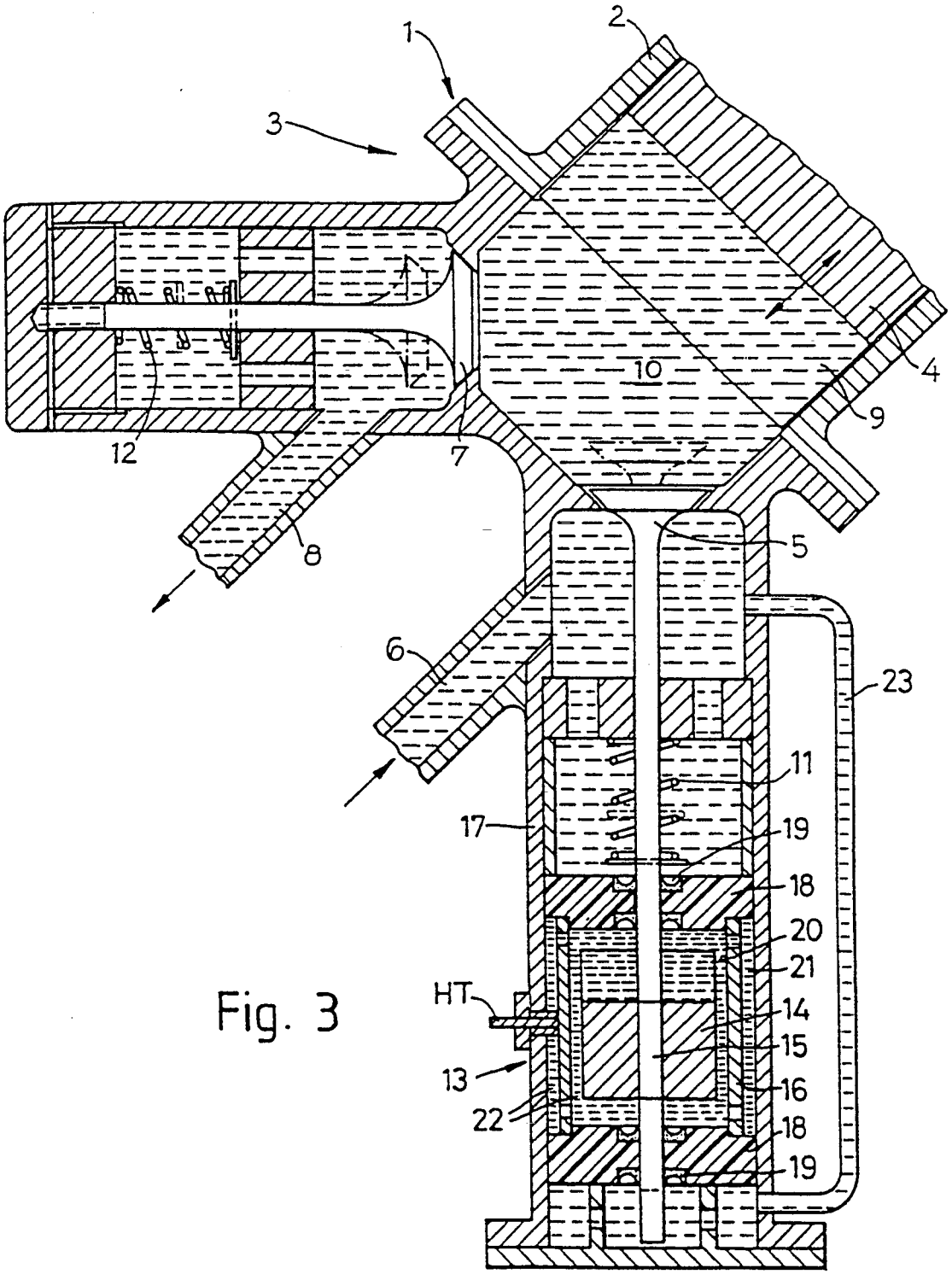
FIGS. 3–6 show respectively four examples of employing ER fluid devices to achieve inlet valve control.

In the example shown in FIG. 3 virtually the entire "conventional" pump is unchanged, but a small ER buffer 13 is added to the inlet valve. This buffer 13 consists of two main parts, namely a piston 14 attached to valve stem 15 of the inlet valve 5, and a sleeve 16 held concentric with cylindrical housing 17 of the inlet valve 5 and the piston 14 by insulating end-plates 18 equipped with seals 19. Annular clearance 20 between the piston and the sleeve and 21 between the sleeve and the housing are each approximately 1 mm. The whole of the buffer 13 is filled with ER fluid 22. An external relief tube 23 is provided to equalise the pressures at each end of the valve stem 15.

When the valve stem 15 moves to and fro, ER fluid is driven from one end of the buffer 13 to the other, passing through the annular gaps 20 and 21 respectively between the piston 14 and the sleeve 16 and between the sleeve 16 and the housing 17. The piston 14 is connected to the housing 17 through the return spring 11 and both are at earth potential. Therefore, when a high voltage is applied to the sleeve 16 via the high tension lead H.T. the ER fluid 22 in the annular flow paths 20, 21 is solidified; this prevents further flow, and further movement of the valve stem 15, until the field is removed.

This arrangement generates large forces to resist movement in relation to the electrical control power required. With no field applied it will act as an ordinary viscous damper; this may or may not be an advantage, depending on circumstances.

Figure 4:
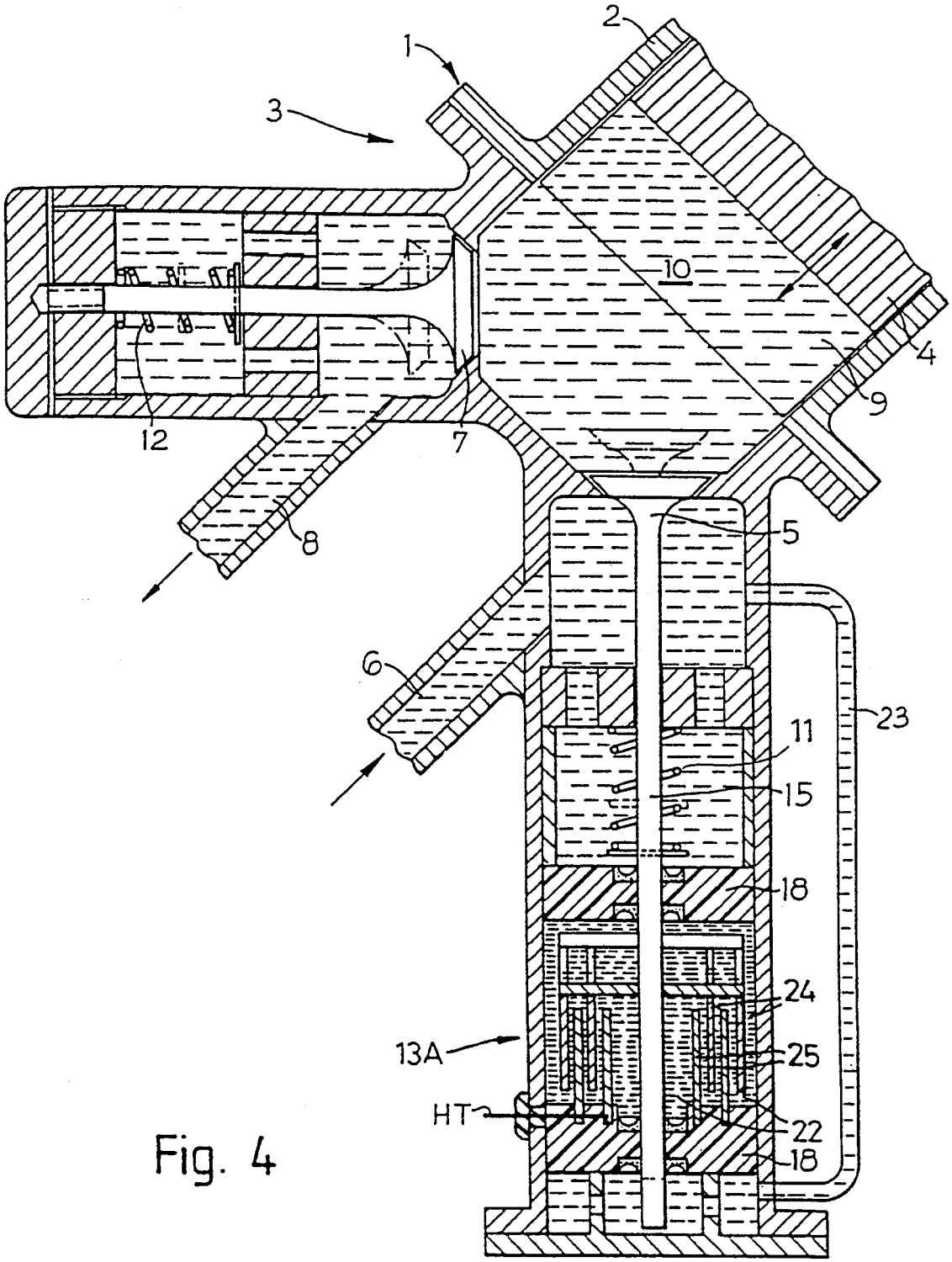

The basic construction exemplified in FIG. 4 is similar to that shown in FIG. 3, but the ER buffer 13A is composed of tubular plates 24, attached to the valve stem 15 and hence movable, interleaved with fixed position, tubular plates 25 attached to the lower end plate 18, by being inset into that end plate. The plates 24 are kept at earth potential through the return spring 11; while the fixed plates 25 have a high voltage connection H.T. A high voltage applied to the fixed plates 25 solidifies the ER fluid 22 between these and the movable earthed plates 24, so the whole assembly acts in the same way as a linear friction brake until the voltage is removed.

This arrangement will require a larger electrical input than that shown in FIG. 3 to generate a given retarding force. On the other hand, it will also have less damping when no electric field is applied. It will be apparent that as the inlet valve 5 closes, the two sets of plates 24, 25, overlap to a greater extent, and the braking effect will become more pronounced. This could be used to advantage in some situations.

Figure 5:
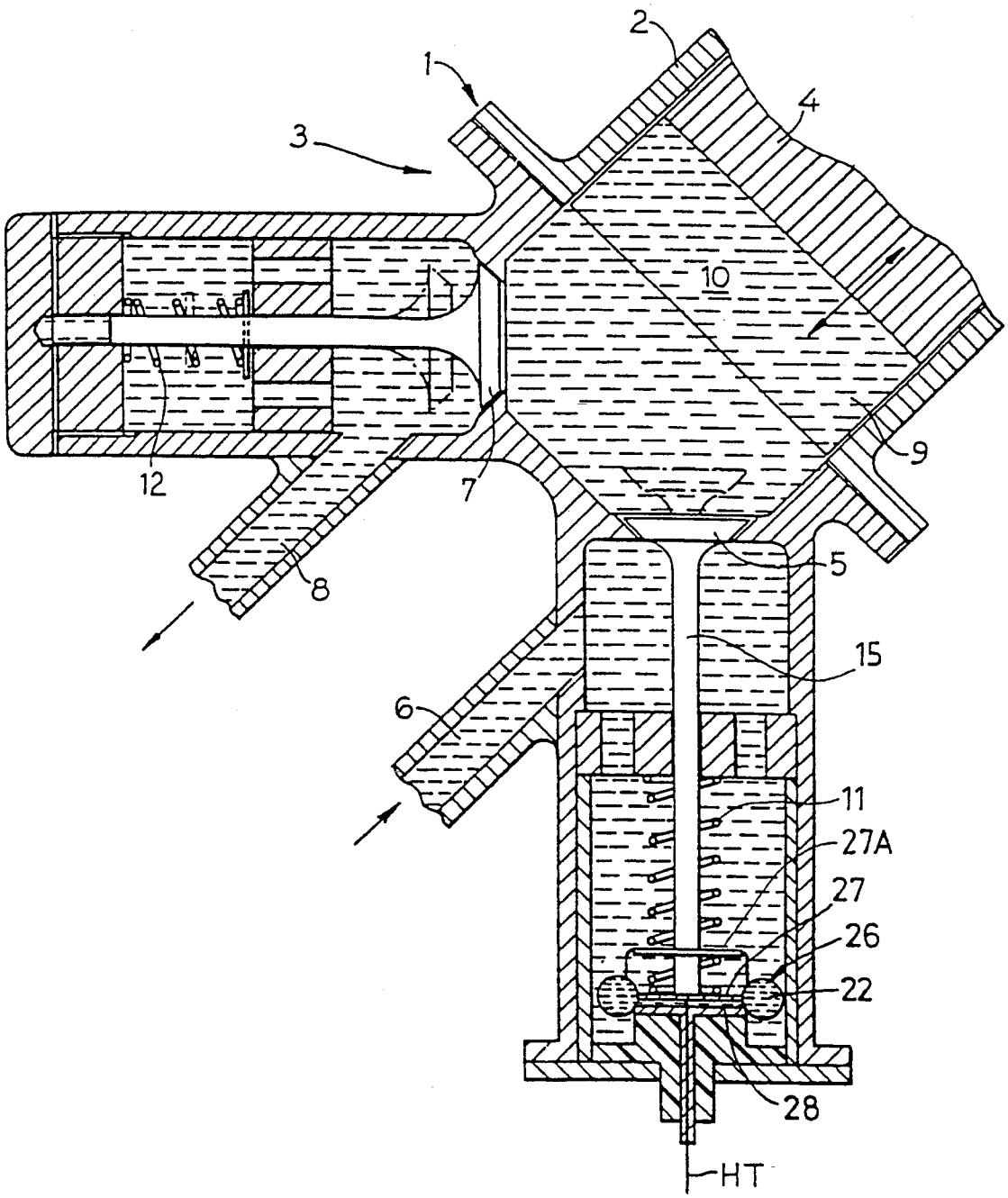

In the example shown in FIG. 5, ER fluid 22 is used in a rather different way to that of FIGS. 3 and 4, in that the force tending to move the valve stem 15 is applied at right angles to the electric field, so the ER fluids are operating in shear. However, ER fluid will also resist forces applied parallel to the electronic field. The main limitation is that the travel available is limited by the maximum gap between the electrodes, which in turn is limited by the maximum working voltage. The behaviour of ER fluids used 'in compression' differs from that of the same fluids used 'in shear' in several respects, but in general much greater forces can be generated by a given electrical input by operating in compression rather than in shear.

The travel required in this particular application is limited, so it is feasible to use ER Fluids in compression. This approach allows smaller electrodes to be used; the small travel and simple construction introduces further simplifications in that the entire ER system may be reduced to a sealed flexible rubber capsule 26 with a top metal plate 27 and a bottom multi-plate 28. When a voltage is applied via the H.T. lead to the plate 28, the capsule 26 resists compression; without a voltage, the two plates 27, 28 can easily be pressed together. Since the ER fluid 22 is totally enclosed within the capsule 26, sliding seals are unnecessary, and the relief tube of FIGS. 3 and 4 can be dispensed with. In FIG. 5, the travel available from a single capsule 26 is shown exaggerated; in practice, the travel would be reduced. Alternatively, two or more capsules 26 could be used in series.

Figure 6:
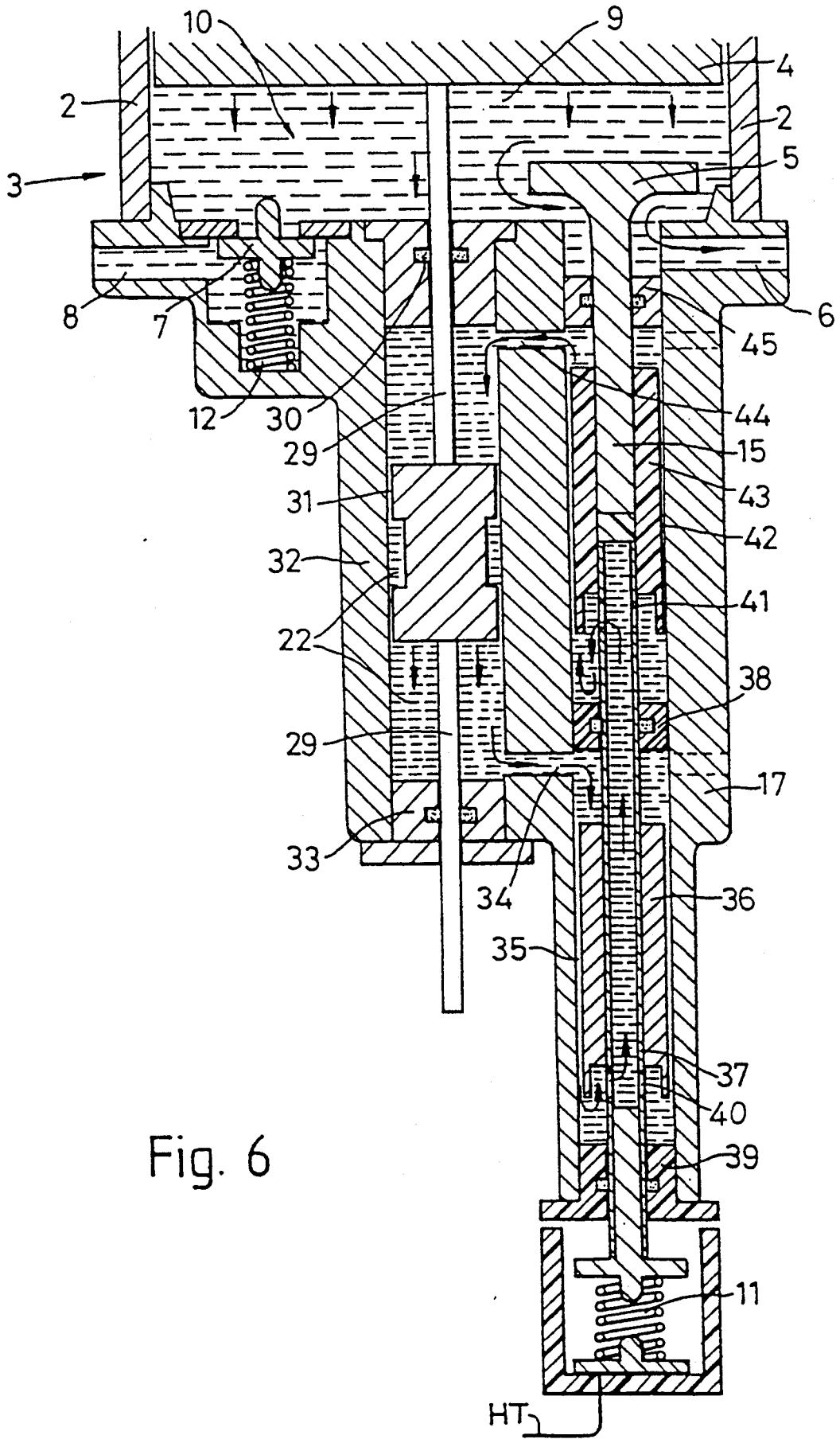

Whilst the embodiments of FIGS. 3 to 5 show ER Fluid being used to brake the inlet valve 5, resisting the normal flow forces generated within the pump 3, the invention is not limited to this and FIG. 6 shows a system where ER fluid is used actively to move the inlet valve 5.

In FIG. 6, an auxiliary rod 29 is attached to the piston 4 and passes through a seal 30 to operate a secondary piston 31 in a secondary cylinder 32 filled with ER fluid 22; to keep the volume constant, the auxiliary rod 29 emerges through a second seal 33. As the piston 4 descends, ER fluid 22 passes through a port 34 and through the annular gap 35 between a metal cylinder 36 and the inlet valve housing 17. The cylinder 36 is fixed to a tube 37 which forms part of the stem 15 of the inlet valve 5, and moves in insulating, sealed guides 38 and 39. Since the housing 17 is at earth potential a voltage applied from the HT lead to the tube 37 through the spring 11 will solidify the ER fluid 22 in this annular gap 35 and therefore increase the pressure above the cylinder 36. This results in closure of the inlet valve 5. Having passed over the cylinder 36, the ER fluid 22 enters the tube 37 through radial ports 40, and passes upwards until it emerges through a second set of radial ports 41. It then passes through a second annular gap 42 between a plastics cylinder 43 and the housing 17 before re-entering the secondary cylinder 32 through port 44. A sealed guide 45 separates the ER fluid 22 from the fluid 9, e.g. oil, in pump 3.

The plastics cylinder 43 balances the no-field pressure drop in the 'working' gap between the cylinder 36 and the housing 17. Since the flow of ER fluid 22 w ill reverse as the piston 4 changes direction, as long as the voltage is maintained on the HT lead, the inlet valve 5 will close as the piston 4 descends and opens as it retreats upwards. However, if the voltage is removed, the inlet valve 5 will stay open all the time.

This basic system can be modified in various ways. By making the second cylinder 43 out of metal, and providing a second HT connection, the inlet valve 5 can be driven in either direction. Although it is clearly convenient in some circumstances to generate the flow of ER fluid from the movement of the piston 4, in others it might be more efficient to have a separate pump. Similarly, poppet valves are widely used for high pressure applications because they seal extremely well. However, they are liable to be unacceptably noisy for some applications, even though the use of ER fluids will allow the closure to be programmed, by reducing the voltage slowly rather than sharply. In such applications, it might be desirable to replace the poppet valves with another type which do not rely on flow forces, which inevitably increase as the valve closes, in their operation. An 'active' ER valve control system, such as that illustrated., would allow such valves to be used.

Thus, the invention basically provides variable displacement performance from a simple, fixed displacement piston pump by providing the possibility of selectively delaying the closure of the inlet valve to 'spill' a predetermined proportion of the total swept volume of the pump back into the low-pressure reservoir, with a view to equating so far as is possible pump output with consumer demand, and thereby providing an energy efficient pump.

The ER fluids can be used to put the invention into effect either passively:

(a) by using ER fluid as a brake, to restrain movement of the inlet valve, which movement results from forces generated by the normal working of the pump. This brake can use the ER fluid in a 'valve', 'clutch' or 'compression' geometry. This approach is simple, but limits the range of valves that can be used in the pump, or actively (b) by using ER fluid as a powered displacement device, to control the movement of the inlet valve directly. The power for this device or actuator may or may not be derived directly from the pump. This approach allows a much wider range of valves to be used in the pump.

I claim:

1. A continuously variable displacement pump comprising a piston reciprocable within a cylinder, a displaceable inlet valve adapted to control admission of lower pressure hydraulic fluid to the swept volume area of the piston and cylinder, a displacement outlet valve adapted to control delivery of higher pressure fluid from the swept volume area, characterised in that an ER fluid device controls the position of the inlet valve so as to control the volume of fluid delivered by the pump in accordance with demand, the ER fluid device being usable in a passive mode as a brake, to restrain movement of the inlet valve, which movement results from forces generated by the normal working of the pump, whereby the output of said single cylinder may be varied from full swept volume to zero, wherein the ER device, in the passive use mode, comprises an ER buffer consisting of two main parts, namely a piston attached to valve stem of the inlet valve, and a sleeve held concentric with a cylindrical housing of the inlet valve and the piston by insulating end-plates equipped with seals, with annular clearance between the piston and the sleeve and between the sleeve and the housing, the whole of the buffer being filled with ER fluid, an external relief tube, to equalise the pressures at each end of the valve stem, and means to apply a high voltage to the sleeve.

2. A continuously variable displacement pump comprising a piston reciprocable within a cylinder, a displaceable inlet valve adapted to control admission of lower pressure hydraulic fluid to the swept volume area of the piston and cylinder, a displacement outlet valve adapted to control delivery of higher pressure fluid from the swept volume area, characterised in that an ER fluid device controls the position of the inlet valve so as to control the volume of fluid delivered by the pump in accordance with demand, the ER fluid device being usable in a passive mode as a brake, to restrain movement of the inlet valve, which movement results from forces generated by the normal working of the pump, whereby the output of said single cylinder may be varied from full swept volume to zero, wherein the ER device, in the passive use mode, comprises an ER buffer composed of tubular plates attached to the valve stem and hence movable, interleaved with fixed position tubular plates attached to a lower, insulating end plate by being inset into that end plate, the movable plates being kept at earth potential through the return spring, while the fixed plates have a high voltage connection.

3. A continuously variable displacement pump comprising a piston reciprocable within a cylinder, a displaceable inlet valve adapted to control admission of lower pressure hydraulic fluid to the swept volume area of the piston and cylinder, a displacement outlet valve adapted to control delivery of higher pressure fluid from the swept volume area, characterised in that an ER fluid device controls the position of the inlet valve so as to control the volume of fluid delivered by the pump in accordance with demand, the ER fluid device being usable in a passive mode as a brake, to restrain movement of the inlet valve, which movement results from forces generated by the normal working of the pump, whereby the output of said single cylinder may be varied from full swept volume to zero, wherein the ER device, in the passive use mode, comprises a sealed flexible rubber capsule with a top metal plate and a bottom metal plate, with means to apply a voltage to the bottom plate.

4. A continuously variable displacement pump comprising a piston reciprocable within a cylinder, a displaceable inlet valve adapted to control admission of lower pressure hydraulic fluid to the swept volume area of the piston and cylinder, a displacement outlet valve adapted to control delivery of higher pressure fluid from the swept volume area, characterised in that an ER fluid device controls the position of the inlet valve so as to control the volume of fluid delivered by the pump in accordance with demand, the ER fluid device being usable in a active mode, as a powered displacement device, to control the movement of the inlet valve directly, whereby the output of said single cylinder may be varied from full swept volume to zero, wherein the ER device, in the active use mode, comprises an auxiliary rod attached to the piston and passing through a sealed guide to operate a secondary piston in a secondary cylinder filled with ER fluid; and, to keep the volume constant, the auxiliary rod emerges through a second seal, with ER fluid passing through a port and through the annular gap between a metal cylinder and the inlet valve housing, the metal cylinder being fixed to a tube which forms part of the stem of the inlet valve, and being movable in insulating, sealed guides, with the housing at earth potential a voltage applied to the tube through the spring to solidify the ER fluid in this annular gap and therefore increase the pressure above the cylinder, resulting in closure of the inlet valve, with the ER fluid, having passed over the cylinder, entering the tube through radial ports, and passing upwards until it emerges through a second set of radial ports, and it then passes through a second annular gap between a plastics cylinder and the housing before re-entering the secondary cylinder through a further port on the other side of the secondary piston, the sealed guide separating the ER fluid from the fluid e.g. oil, in the pump, while the plastics cylinder balances the no-field pressure drop in the working gap between the cylinder and the housing.

* * * * *